US009039480B2

(12) United States Patent
Wolfinbarger

(10) Patent No.: US 9,039,480 B2
(45) Date of Patent: May 26, 2015

(54) ACTION FIGURES WITH SLIDE DEVICES AND METHODS OF USE

(75) Inventor: Ryan Wolfinbarger, Avon, IN (US)

(73) Assignee: Gigglicious, LLC, Avon, IN (US)

( * ) Notice: Subject to any disclaimer, the term of this patent is extended or adjusted under 35 U.S.C. 154(b) by 283 days.

(21) Appl. No.: 13/415,435

(22) Filed: Mar. 8, 2012

(65) Prior Publication Data

US 2013/0237119 A1 Sep. 12, 2013

(51) Int. Cl.

*A63H 33/32* (2006.01)
*A63H 3/36* (2006.01)
*A63H 17/24* (2006.01)

(52) U.S. Cl.

CPC ..... *A63H 3/36* (2013.01); *A63H 33/32* (2013.01); *A63H 17/24* (2013.01)

(58) Field of Classification Search

CPC ..... A63H 7/00; A63H 7/02; A63H 15/00; A63H 15/02; A63H 17/24; A63H 33/32
USPC ..... 446/70, 166–170, 268, 314–316, 433; 463/69

See application file for complete search history.

(56) References Cited

U.S. PATENT DOCUMENTS 3,590,523 A * 7/1971 Riesgraf ..... 446/433
3,611,622 A * 10/1971 Lelelson ..... 446/179
3,685,942 A * 8/1972 Shaffer ..... 425/276
3,926,435 A * 12/1975 Nacci ..... 463/69
4,455,752 A * 6/1984 Koulouras ..... 33/41.4
4,708,688 A * 11/1987 Lee ..... 446/288
4,836,820 A * 6/1989 Ebihara et al. ..... 446/289
4,923,427 A * 5/1990 Roland ..... 446/153
D324,706 S * 3/1992 Gibson ..... D21/635
5,279,871 A * 1/1994 Segan et al. ..... 428/18
5,585,123 A * 12/1996 Busby ..... 425/276
5,947,788 A * 9/1999 Derrah ..... 446/154
6,415,926 B1 * 7/2002 Long ..... 206/575
6,416,097 B1 * 7/2002 O'Rourke ..... 294/179
6,612,632 B2 * 9/2003 Campbell ..... 37/444
7,513,504 B2 * 4/2009 Lochtefeld ..... 273/441
2009/0298379 A1 * 12/2009 Henson et al. ..... 446/26
2010/0248581 A1 * 9/2010 Adams ..... 446/70
2012/0156958 A1 * 6/2012 Adams et al. ..... 446/70

OTHER PUBLICATIONS

"WIVB: How to Create an Ice Luge Run in your Backyard", Feb. 2, 2009 [retrieved online Aug. 6, 2014].*

* cited by examiner

*Primary Examiner* — Kurt Fernstrom
(74) *Attorney, Agent, or Firm* — Cooley LLP

(57) ABSTRACT

In some embodiments, a kit includes a slide device and an action figure coupled to the slide device. The kit also includes a tool configured to modify a shape of a base material such that a path that has a non-zero height is defined within the base material. The action figure and the slide device can collectively slide down at least a portion of the path when disposed on the path. The base material can be, for example, snow or sand. In some embodiments, the tool can include tool body having a length dimension, a width dimension and a height dimension. The length dimension can be greater than the width dimension and the height dimension can be greater than at least half a height dimension of the slide device and the action figure collectively. A handle can be coupled to the tool body.

20 Claims, 18 Drawing Sheets

ACTION FIGURES WITH SLIDE DEVICES AND METHODS OF USE

BACKGROUND

Some embodiments relate generally to toy action devices, and more particular, to toy action figures and slide devices that can slide down a path formed in a base material or can slide down a track.

Some known toy action devices can be used in water, such as, for example, an action figure couplable to a toy surfboard that can float. Some known toy action devices include wheels such that the toy action figure can roll on or down a track. For example, toy vehicles (e.g., cars, trucks) can roll on a surface, such as, for example, a floor surface or a top surface of a table. Various track devices are known for use with such toy vehicles and such track devices typically have a smooth surface on which the toy vehicle can roll. Because such track devices are typically configured to accommodate toy action devices that include wheels, such track devices may not be suitable to accommodate a sliding movement of a toy action figure, such as, for example, a toy snowboard or toy sled. For example, the material of the track and/or the surface of the track may not allow for sliding movement of such toy action devices, such that the toy action device can maintain an upright position during sliding movement on the track.

Thus, a need exists for action devices that can slide on a track or on a path formed in a base material, such as snow or sand and related kits. Also, a need exists for tools that can be used to form such a path within a base material.

SUMMARY

In some embodiments, a kit includes a slide device and an action figure coupled to the slide device. The kit also includes a tool configured to modify a shape of a base material such that a path that has a non-zero height is defined within the base material. The action figure and the slide device can collectively slide down at least a portion of the path when disposed on the path. The base material can be, for example, snow or sand. In some embodiments, the tool can include tool body having a length dimension, a width dimension and a height dimension. The length dimension can be greater than the width dimension and the height dimension can be greater than at least half a height dimension of the slide device and the action figure collectively. A handle can be coupled to the tool body.

DETAILED DESCRIPTION

Apparatus, kits and methods are described herein related to action figures and slide devices that can slide down a path formed in a base material, such as, for example, snow or sand, or can slide down a track. As described herein, an action figure can be coupled to a slide device and the action figure and slide device can collectively slide down the path or track. For example, the slide device can include a substantially planar surface that can slide on a surface of a path formed in a base material or can slide on a surface of a track. The track can include a textured surface on which the substantially planar surface of the slide device can slide when the action figure and slide device are disposed on the track.

In some embodiments, a kit can include a slide device and an action figure coupled to the slide device. The kit also includes a tool configured to modify a shape of a base material such that a path is defined within the base material that has a non-zero height. The action figure and the slide device can collectively slide down at least a portion of the path when disposed on the path. The base material can be, for example, sand or snow.

In some embodiments, a kit includes a slide device including a substantially planar surface, an action figure coupled to the slide device, and a track that can receive the slide device and the action figure collectively. The track has a textured surface configured to slidably contact the substantially planar surface of the slide device. The slide device and the action figure can slide down at least a portion of the track when disposed on the track and the substantially planar surface of the slide device contacts the textured surface of the track.

In some embodiments, an apparatus includes a support member and tool body coupled to the support member. The tool body has a substantially cylindrical shaped portion configured to modify a shape of a base material to define a path within the base material that an action figure and a slide device collectively slide down when disposed on the path. The apparatus also includes a handle coupled to the support member.

In some embodiments, a method includes forming a path within a base material using a tool member. The path can have a width greater than a width of a slide device and a height greater than one half of a height of the slide device and an action figure collectively. The slide device and the action figure collectively can be disposed on the path such that the slide device and the action figure collectively slide down the path.

As used in this specification, the singular forms "a," "an" and "the" include plural referents unless the context clearly dictates otherwise. Thus, for example, the term "a base material" is intended to mean a single base material or a combination of base materials.

Figure 1:
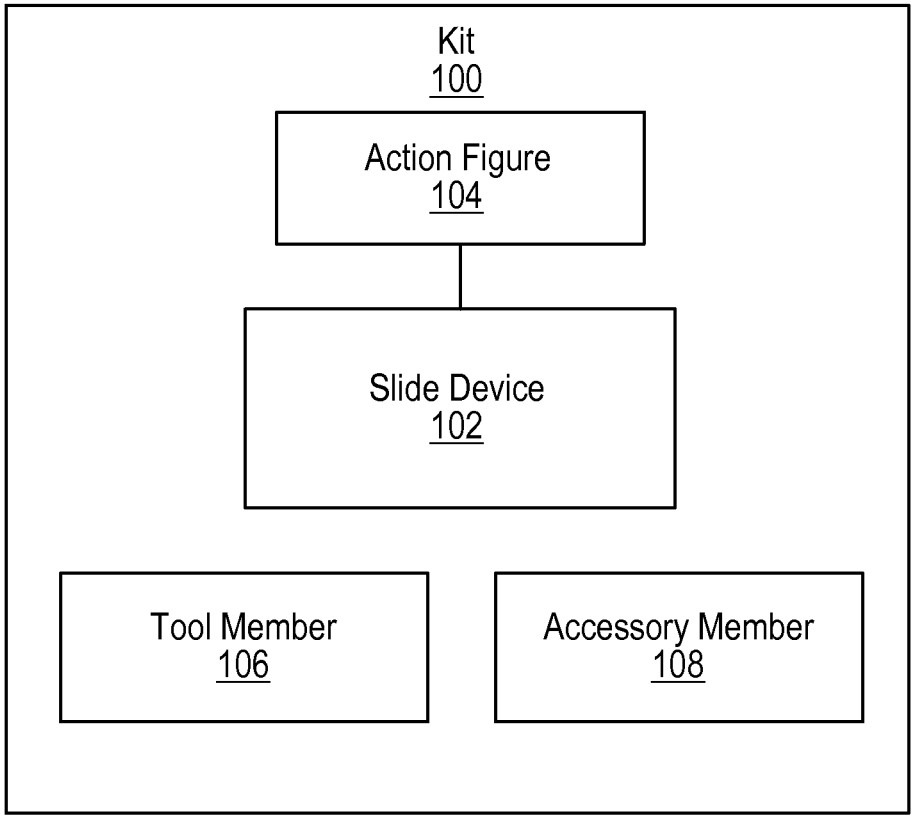
FIG. 1 is a schematic illustration of a kit, according to an embodiment.

FIG. 1 is a schematic illustration of a kit according to an embodiment. A kit 100 includes a slide device 102, an action figure 104, and a tool member 106 (also referred to herein as a "tool"). The kit 100 can also optionally include one or more accessory member 108 (also referred to herein as an "accessory device"). Although one slide device 102, action figure 104, tool member 106 and accessory member 108 are shown in FIG. 1, the kit 100 can alternatively include more than one slide device 102, action figure 104, tool member 106 and/or accessory member 108.

The action figure 104 can be, for example, in the form or shape of a person or animal that can be coupled to the slide device 102. The action figure 104 can be coupled to the slide device 102. For example, the action figure 104 can be removably coupled to the slide device 102 with a snap-fit coupling, a press-fit coupling, a hook and loop coupling, a strap or buckle, or other suitable coupling method. In alternative embodiments, the action figure 104 can be fixedly coupled to the slide device 102. In another alternative embodiment, the action figure 104 can be formed monolithically with the slide device 102. As used herein, the action figure 104 can be considered to be coupled to the slide device 102 when the action figure 104 is removably coupled to the slide device 104, fixedly coupled to the slide device 102 or formed monolithically with the slide device 102.

The slide device 102 can be, for example, a snow board, a sled, a bobsled, a pair of skis, a snow mobile, or other similar device that can provide sliding movement. The slide device 102 includes a bottom surface that is substantially planar such that the slide device 102 can slide on a surface of a path or track as described in more detail below. For example, when the slide device 102 is in the form of a snowboard, a bottom surface of the snowboard that contacts snow (or a surface of a track) can be substantially planar. In some embodiments, the substantially planar surface of the slide device 102 can be textured.

The tool member 106 can include a tool body (not shown in FIG. 1), a support member (not shown in FIG. 1) and a handle (not shown in FIG. 1) that can be coupled to the tool body and/or the support member or formed monolithically with the tool body and/or support member. The tool member 106 can be used by a user to modify a shape of a base material to define a path in the base material on which the slide device 102 and action figure 104 collectively can slide. The base material can be, for example, snow, sand or dirt. The tool body can define, at least in part, a shape and size of the path that can be formed in the base material. For example, the tool body of the tool member 106 can be sized and shaped to form a path in the base material that has a width greater than a width of the slide device 102 and/or a width of the slide device 102 and the action figure 104 collectively, and the path can have a non-zero height. The path formed by the tool member 106 can be formed, for example, with a sufficient downward slope such that the slide device 102 and the action figure 104 can collectively slide down the path.

The slide device 102 and the action figure 104 can collectively have a height relative to the non-zero height of the path such that the slide device 102 and the action figure 104 can maintain a substantially upright orientation when sliding down at least a portion of the path. In other words, the slide device 102 and the action figure 104 can collectively right themselves when sliding down the path and when the slide device 102 and action figure 104 collectively contact a side wall of the base material bounding the path. Such a height relative to the non-zero height of the path can be particularly relevant in an embodiment in which the slide device and action figure collectively are used on a path that includes a curved portion as described below. In some embodiments, the action figure 104 can have a height for example, of 95 mm and the slide device 102 can have a height or thickness of 6 mm. Thus, a total height of the slide device 102 and the action figure 104 can be, for example, 95.6 mm.

The action figure 104 can also have a weight relative to the weight of the slide device 102 and/or a size (e.g., height) relative to the slide device 102 such that when the action figure 104 is coupled to the slide device 102 and the action figure 104 and the slide device 102 collectively slide down the path formed by the tool member 106, the slide device 102 and the action figure 104 can collectively maintain an upright position and/or can right themselves as described above. For example, the action figure 104 can have a weight that is relatively light relative to a weight of the slide device 102. For example, in some embodiments, the action figure 104 can have a weight of 16.5 grams and the slide device can have a weight of 27.5 grams. In some embodiments, a ratio of the weight of the slide device 102 to the weight of the action figure 104 can be, for example, 62.5%:37.5%.

Thus, the height of the action figure 104 and the overall height of the action figure 104 and the slide device 104 collectively, together with the weight of the action figure 104 and the slide device 102 collectively and relative to each other can contribute to the ability of the action figure 104 and the slide device 102 to slide down a sloped path formed by the tool member without tipping over (e.g., ability to right themselves when contacting a wall or side of the path). A change in the height of the action figure 104 and/or the height of the action figure 104 and the slide device 102 collectively can shift the center of gravity of the action figure 104 and the slide device 104 collectively and affect the speed and/or ability of the action figure 104 and the slide device 102 collectively to slide down the path formed by the tool member 106. In addition, the size of the substantially planar surface of the slide device 102 can also be a factor in the ability of the slide device 102 and the action figure 104 to be able to slide down the path and right themselves as described above. For example, in some embodiments, the substantially planar surface of the slide device 102 can have a width of 34 mm, a length of 135 mm and a surface area of 4590 $mm^2$.

The tool body can have, for example, a length dimension, a width dimension and a height dimension such that the tool member 106 can form a path as described above with a desired width and height to accommodate the slide device 102 and action figure 104. In some embodiments, the length dimension of the tool body can be greater than the width dimension of the tool body, and the height dimension of the tool body can be greater than at least half a height dimension of the slide device 102 and the action figure 104 collectively. Thus, the tool member 106 can form a path in the base material that is, for example, at least greater than one half of a height of the slide device 102 and the action figure 104 collectively. In alternative embodiments, the tool member 106 can form a path in the base material that is, for example, at least greater than two thirds of the height of the slide device 102 and the action figure 104 collectively. In another alternative embodiment, the tool member 106 can form a path in the base material that is, for example, substantially the same height as the action figure 104 and the slide device 102 collectively.

In some embodiments, the tool body includes a substantially cylindrical portion that defines at least in part a shape of the path formed by the tool body. Alternatively or additionally, the tool body can include a curved portion that defines at least in part a shape of the path formed by the tool body. In yet other alternatives or additions, the tool body can include a curved portion that curves in a direction of either the width dimension or the height dimension of the tool body, or both. The amount of curvature of the tool body can vary. In some embodiments, the tool body includes a curved portion that curves approximately 45 degrees in a direction of the width dimension or the height dimension of the tool body, or both. In some embodiments, the degree of curvature can be 25 degrees, 30 degrees, 45 degrees, 60 degrees, 90 degrees, or any degree of curvature between, for example, 0 and 180 degrees. In some embodiments, the tool body is substantially tubular shaped. When the tool body includes a curved portion, the corresponding path formed by the tool member 106 can include a curved portion. In such an embodiment, because of the height of the path relative to the slide device 102 and the action figure 104 collectively, as described above, the slide device 102 and the action figure 104 can collectively maintain a substantially upright orientation, or a self-righting orientation when sliding down the curved portion of the path.

As shown in FIG. 1, the kit 100 can optionally include one or more accessory member 108 that can be disposed within the path formed by the tool member 106. The accessory member 108 can be, for example, a jump device such as, a wedge shaped device, a rectangular block, or other device having a flat, curved, angled or ramped contact surface. The accessory member 108 can include a contact surface on which the substantially planar surface of the slide device 102 can slide. The contact surface of the accessory member 108 can be flat or substantially planar, or can be curved or angled. In some embodiments, the contact surface of the accessory member 108 can be textured. Although not shown in FIG. 1, the kit 100 can also optionally include other accessory members, such as, for example, a start flag and a finish flag, a bridge member, a tunnel member and/or a rail member, each of which can be disposed on the base material within or near the path formed by the tool 106.

Figure 2:
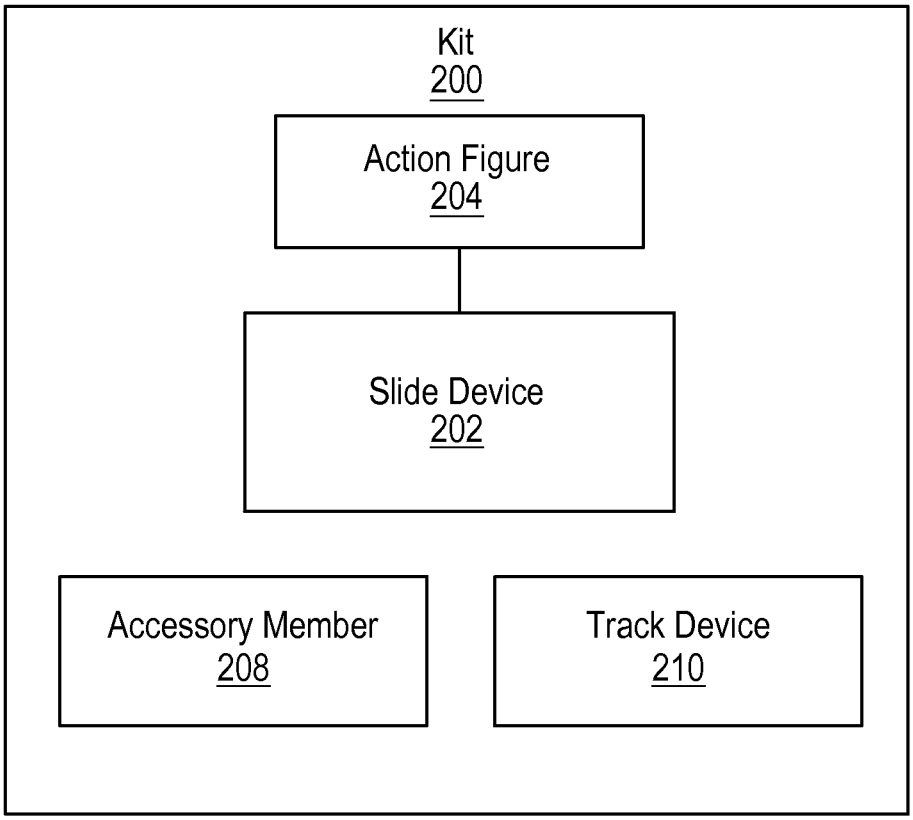
FIG. 2 is a schematic illustration of another kit, according to an embodiment.

FIG. 2 is a schematic illustration of a kit according to another embodiment. A kit 200 includes a slide device 202, an action figure 204, a track device 210 and an accessory member 208. As with the previous embodiment, although one slide device 202, action figure 204, track device 210 and accessory member 208 are shown in FIG. 2, the kit 200 can alternatively include more than one slide device 202, action figure 204, track device 210 and/or accessory member 208. The slide device 202 and the action figure 204 can each be formed the same as or similar to, and perform the same as or similar functions as the slide device 102 and the action figure 104 described for FIG. 1. For example, the slide device 202 can be a snow board, a sled, a bobsled, a pair of skis, a snow mobile, or other similar device used for sliding movement. The action figure 204 can be, for example, in the form or shape of a person or animal and can be fixedly or removably coupled to the slide device 202.

The slide device 202 includes a bottom surface that is substantially planar such that the slide device 202 can slide on a surface of the track device 210. The track device 210 can include a support (not shown in FIG. 2) and a track (not shown in FIG. 2). The track can be formed monolithically with the support or can be formed separately from and coupled to the support. The track of the track device 210 can receive the slide device 202 and the action figure 204 collectively, and can have a textured surface that can slidably contact the substantially planar surface of the slide device 202 when the slide device 202 and the action figure 204 collectively slide down at least a portion of the track. The textured surface of the track can include a base portion and multiple raised portions that protrude above the base portion to form the textured surface. The textured surface of the track can have a surface coefficient of friction that is lower than a surface coefficient of friction of a track that does not have a textured surface (e.g., a surface that is smooth). The lower surface coefficient of friction of the material can provide for less friction between the substantially planar surface of the slide device 202 and the surface of the track that contacts the substantially planar surface of the slide device 202 when the slide device 202 and action figure 204 collectively slide on at least a portion of the track. In some embodiments, the track is formed with a high-density polyethylene (HDPE) material or an ultra-high-molecular-weight polyethylene (UMHW PE) material, or both.

The accessory member 208 can be disposed on, or coupled to, the track device 210 such that the slide device 202 and the action figure 204 can collectively slide on a surface of the accessory member 208 when sliding down the track of the track device 210. The accessory member 208 can be, for example, a jump device, such as, a wedge shaped device, a rectangular block, or other device having a flat, curved, angled or ramped contact surface, on which the slide device 202 and the action figure 204 can collectively slide when sliding down the track of the track device 210. The accessory member 208 can include a contact surface on which the substantially planar surface of the slide device 202 can slide as described above for FIG. 1. The accessory member 208 can alternatively be disposed beneath the track device 210 such that the accessory member 208 can contact a bottom surface of the track of the track device 210 and change the shape of the track of the track device 210. The accessory member 208 can also be a rail, tunnel, bridge, start flag, finish flag, or other accessory. The accessory member 208 can be coupled to the track device 210 with a snap-fit coupling, a press-fit coupling, a hook and loop coupling, snaps, threaded fasteners, or other suitable coupling method. The accessory member 208 can be coupled to the track and/or the support of the track device 210.

Figure 3A:
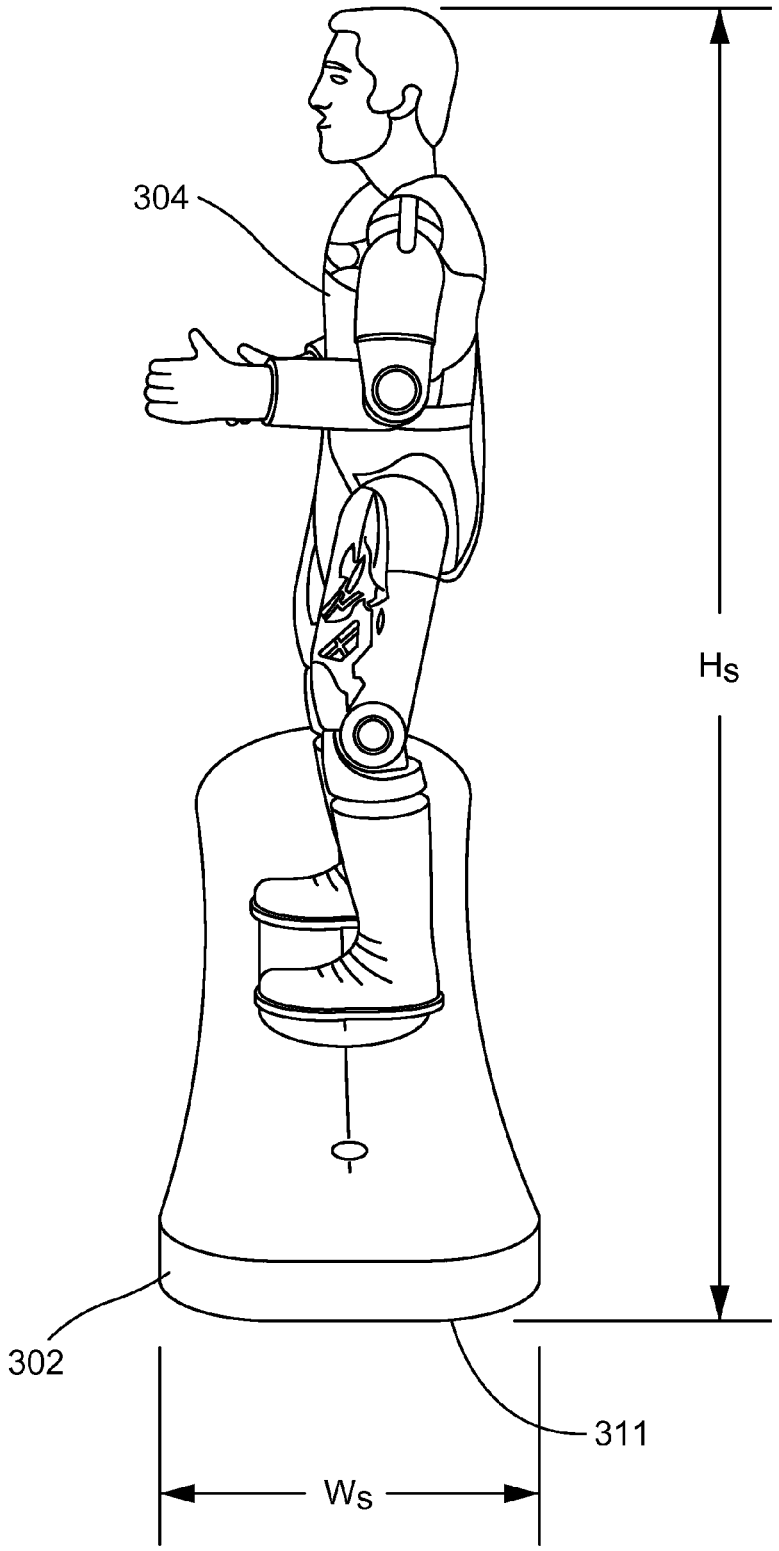
FIG. 3A is a front perspective view of a slide device and an action figure, according to an embodiment.
Figure 3B:
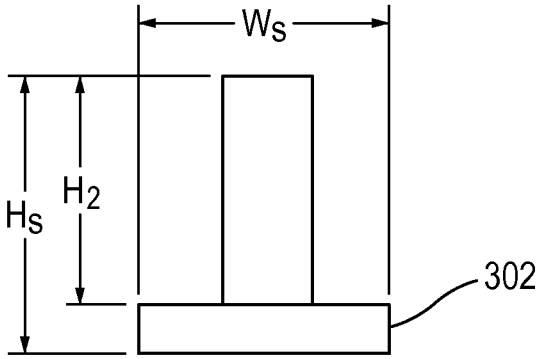
FIG. 3B is a schematic illustration of a front view of the slide device and action figure of FIG. 3A.
Figure 3C:
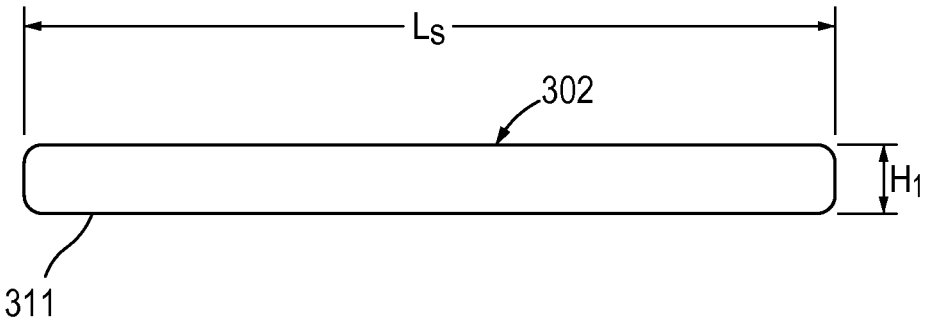
FIG. 3C is a side view of the slide device of FIG. 3A.
Figure 4:
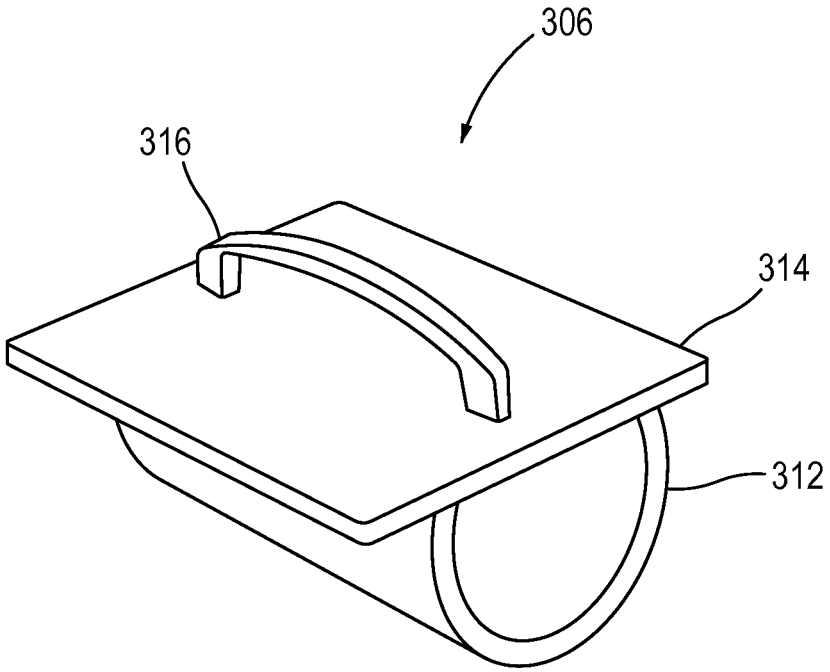
FIG. 4 is a side perspective view of a tool member, according to an embodiment.

FIGS. 3A-3C illustrate a slide device 302 and an action figure 304, and FIGS. 4-6 illustrate a tool member 306, according to an embodiment. The slide device 302, action figure 304, and tool member 306 can each be included in a kit similar to the kit 100 described above for FIG. 1. In this embodiment, the slide device 302 is in the form of a snowboard. The action figure 304 is the form of a person (e.g., snowboarder) and can be coupled to the slide device 302 with various coupling methods, such as, for example, a removable coupling such as a snap-fit coupling or a press-fit coupling, or a fixed coupling. The slide device 302 includes a substantially planar bottom surface 311 (see, e.g., FIG. 3C) that can slide on a track (as described above for FIG. 2) or a path formed in a base material (as described above for FIG. 1 and as described in more detail below). As shown in FIGS. 3B and 3C, the slide device 302 has a length $L_s$, a width $W_s$ and a height $H_1$, and the action figure 302 has a height $H_2$. Thus, when the action figure 304 is coupled to the slide device 302, the slide device 302 and action figure 304 collectively have a height $H_s$, a width $W_s$, and a length $L_s$, as shown in FIG. 3A and as shown in the schematic illustration of FIG. 3B. A surface area A of the substantially planar surface 311 of the slide device 302 is therefore equal to $L_s \times W_s$.

Figure 5:
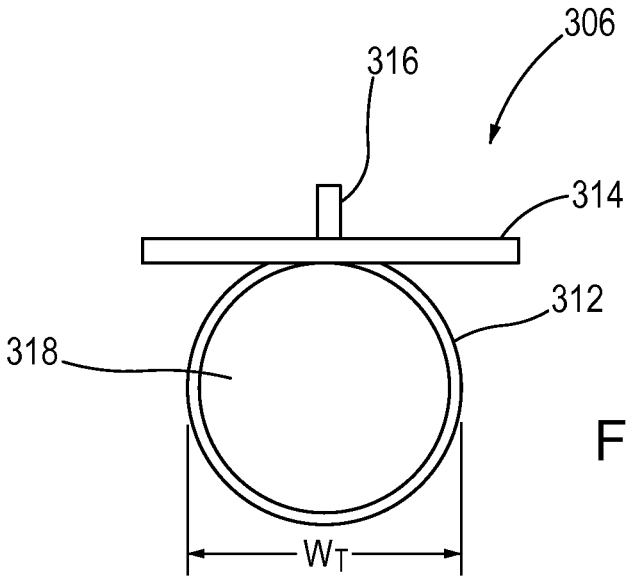
FIG. 5 is an end view of the tool member of FIG. 4.
Figure 6:
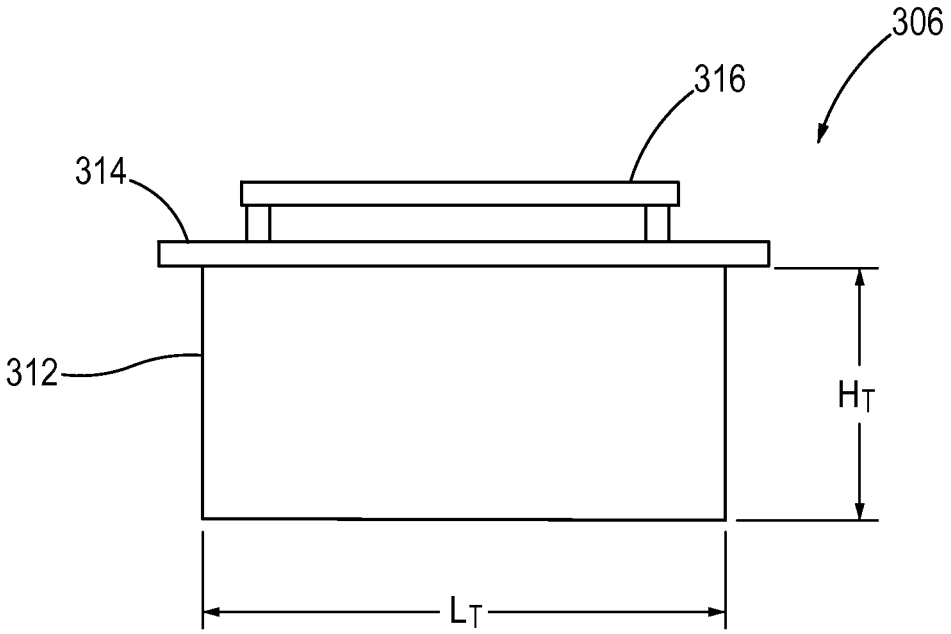
FIG. 6 is a side view of the tool member of FIG. 4.
Figure 8:
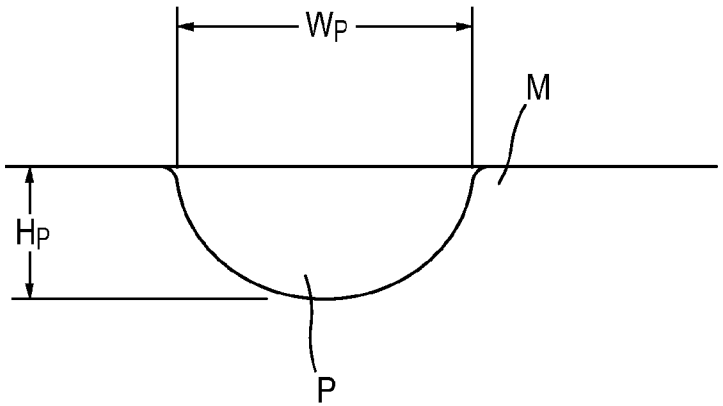
FIG. 8 is an end view of the path of FIG. 7.
Figure 7:
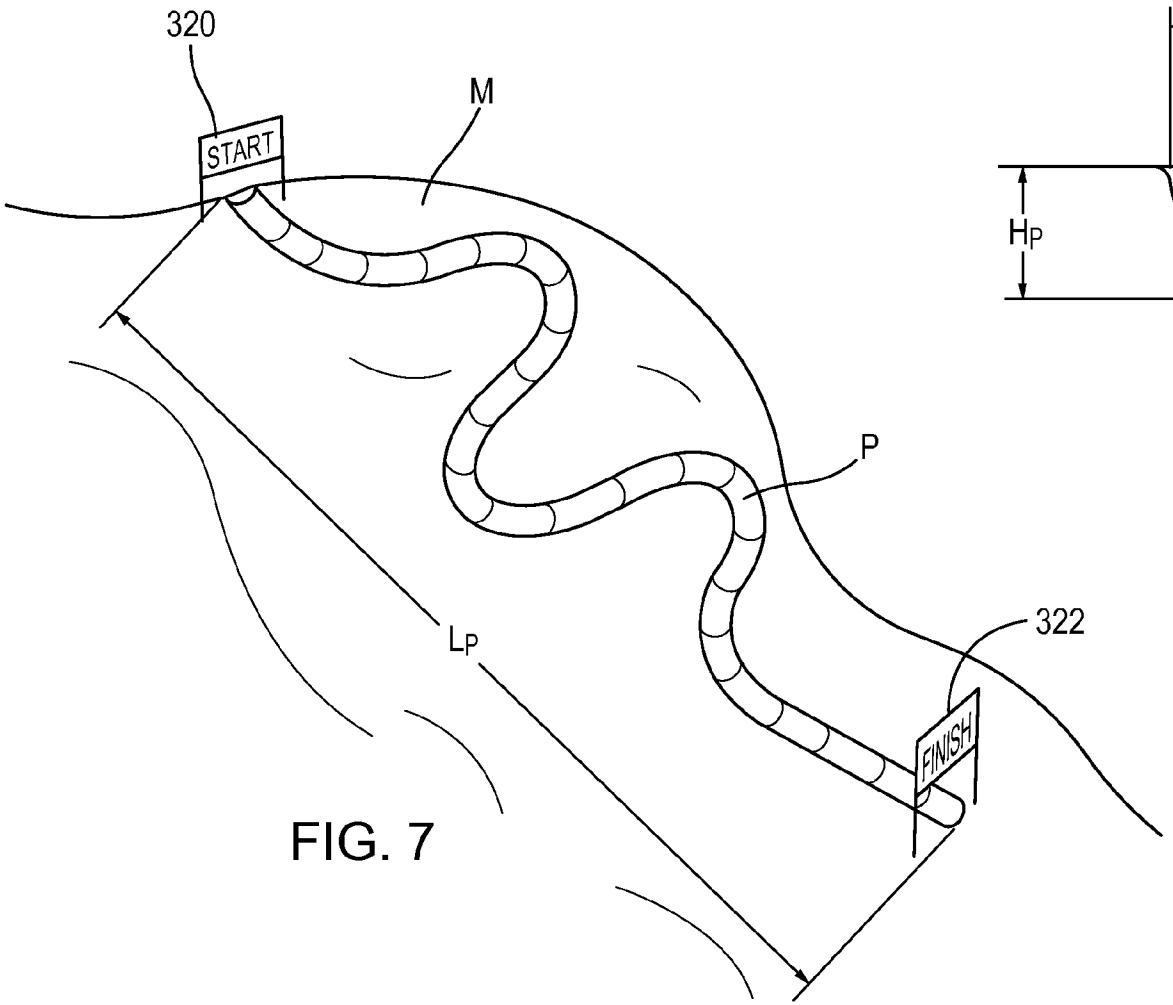
FIG. 7 is an illustration of a path formed in a base material.

The tool member 306 includes a tool body 312 coupled to a support member 314, and a handle 316 is coupled to the support member 314. The tool member 306 can be used to form a path P in a base material M (e.g., snow or sand), as shown in FIG. 7. The tool body 312 defines an interior region 318 that defines a shape and size of the path P that can be formed in the base material M. The tool body 312 can have, for example, substantially cylindrical shape. The tool body 312 can have a width $W_T$ (as shown in FIG. 5), and a length $L_T$ and a height $H_T$ (as shown in FIG. 6). In some embodiments, the height $H_T$ of the tool body 312 can be, for example, greater than at least one half the height $H_s$ of the slide device 302 and action figure 304 collectively such that the path P formed in the base material M by the tool member 306 can have a height $H_p$ (as shown in FIG. 8) that is greater than at least one half the height $H_s$ of the slide device 302 and action figure 304 collectively. The width $W_T$ of the tool body 312 can be, for example, greater than a width $W_s$ of the action figure 304 and slide device 302 collectively such that the path P formed by the tool member 306 has a width $W_p$ (shown in FIG. 8) greater than the width $W_s$ of the action figure 304 and slide device 302 collectively. As described above for FIG. 1, the tool body 312 can include other size dimensions relative to the action figure 304 and the slide device 102. The tool member 306 can be used to form a path P having any desired length $L_p$, as shown for example in FIG. 7.

As described above for FIG. 1, the size and weight of the slide device 302 and the action figure 304 relative to each other and collectively relative to, for example, a height of the path P can allow the slide device 302 and the action figure 304 collectively to be able to slide down the path P without tipping over. In other words, the slide device 102 and the action figure 104 can collectively right themselves if they contact a side wall of the base material M bounding the path P. For example, as the slide device 302 and the action figure 304 collectively slide down the path P shown in FIG. 7, if the slide device 302 and the action figure 304 contact a side wall of base material M bounding the path P, for example, near or at a curved portion of the path P, the slide device 302 and the action figure 304 can maintain an upright orientation.

The kit in which the action figure 304, slide device 302 and tool member 306 are included can also optionally include accessory devices such as a start flag 320 and finish flag 322 shown in FIG. 7. The kit in which the action figure 304, slide device 302 and tool member 306 are included can also optionally include one or more accessory members, such as accessory members 108 and 208 described above. Such accessory members can be disposed on the path P formed by the tool member 306.

Figure 9:
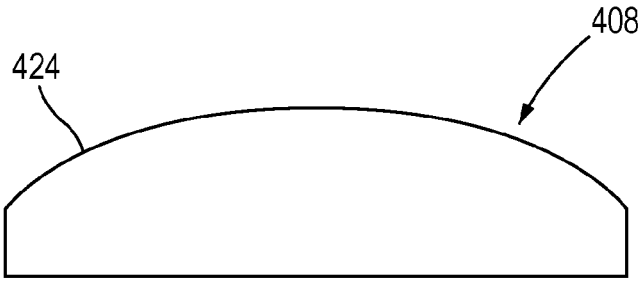
FIGS. 9-11 are each a side view of a different embodiment of an accessory member.
Figure 10:
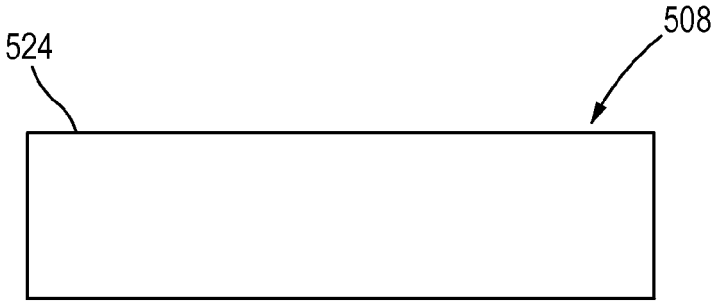
Figure 11:
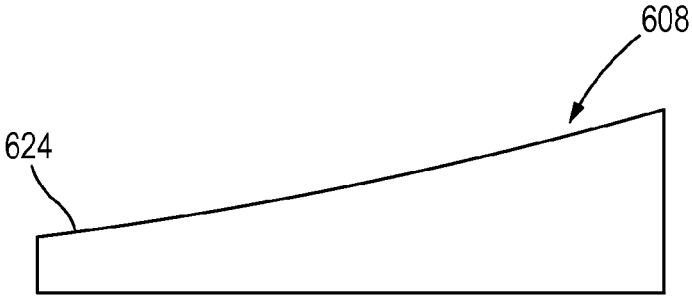

FIGS. 9-11 are each a schematic illustration of an example of an accessory member that can be included in a kit (e.g., kit 100, kit 200), as described herein. Each of the accessory members described with respect to FIGS. 9-11 can be used as a ramp on a path formed in a base material (e.g., snow or sand) or on a track device, as described herein. For example, each of the accessory members described with respect tot FIGS. 9-11 can include a coupling mechanism (not shown) as described above to couple the accessory member to a track device (not shown).

Figure 14:
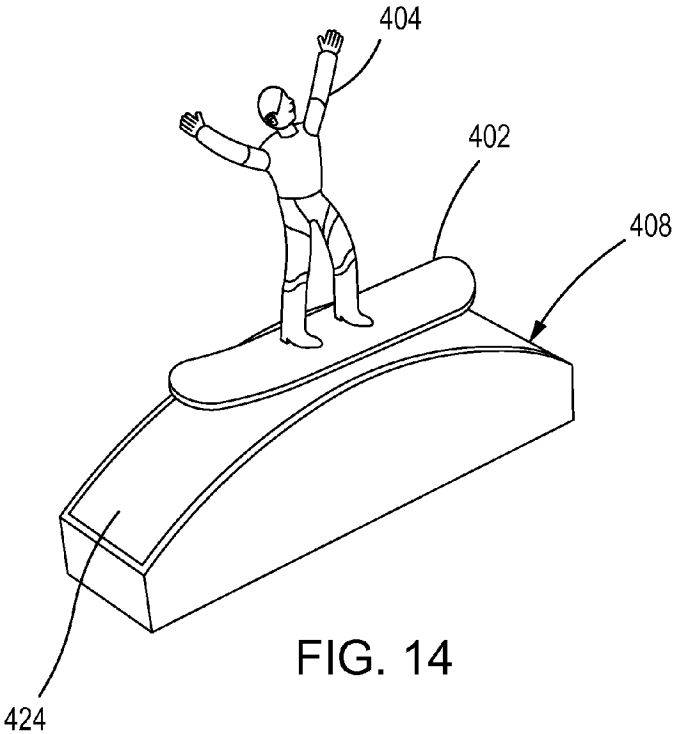
FIG. 14 is a perspective view of an accessory member, an action figure and a slide device, according to another embodiment.
Figure 15:
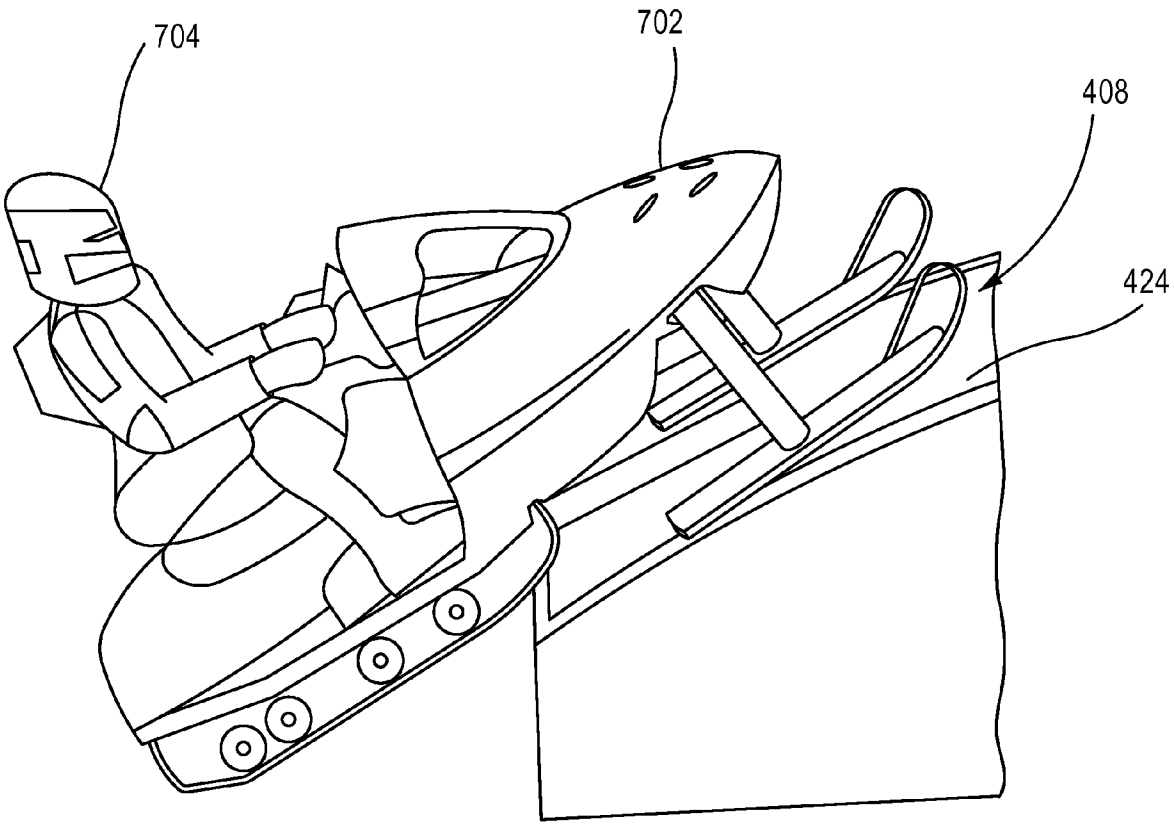
FIG. 15 is a side view of an accessory member and an action figure according to another embodiment.

FIG. 9 illustrates an accessory member 408 that has a curved upper surface 424 that has a convex curvature on which a substantially planar surface of a slide device can slide. For example, FIG. 14 illustrates the accessory member 408 with a slide device 402 in the form of a snowboard and an action figure 404 coupled to the slide device 402 collectively disposed on the curved upper surface 424. FIG. 15 illustrates a slide device 702 in the form of a snow mobile and an action figure 704 coupled to the slide device 702 that are disposed on a portion of the accessory device 408. In this embodiment, the action figure 704 is coupled to the slide device 702 in a seated position.

Figure 12:
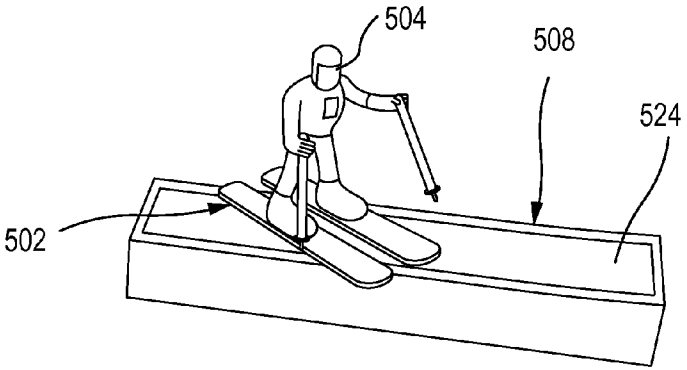
FIG. 12 is a perspective view of an accessory member, an action figure and a slide device, according to an embodiment.
Figure 13:
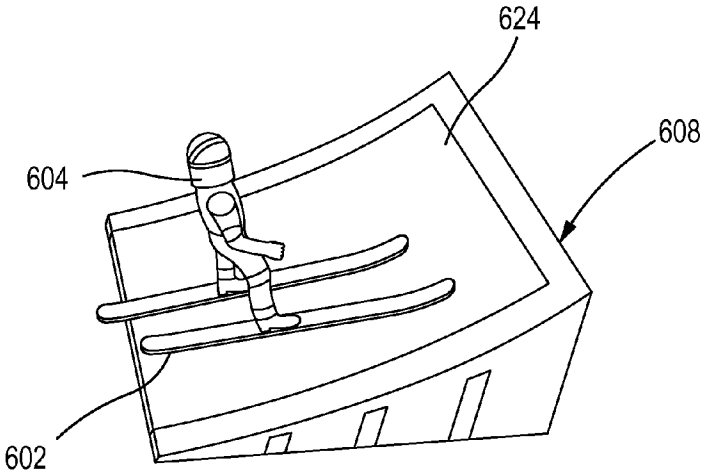
FIG. 13 is a perspective view of an accessory member, an action figure, and a slide device, according to another embodiment.

FIG. 10 illustrates an accessory member 508 that has a substantially flat or planar upper surface 524 on which a substantially planar surface of a slide device can slide. For example, FIG. 12 illustrates the accessory member 508 with a slide device 502 in the form of a pair of skis and an action figure 504 coupled to the slide device 502 that are collectively disposed on the upper surface 524. FIG. 11 illustrates an accessory member 608 that has an upper surface 624 that has a slight concave curvature on which a substantially planar surface of a slide device can slide. For example, FIG. 13 illustrates the accessory member 608 with a slide device 602 in the form of a pair of skis and an action figure 604 coupled to the slide device 602 that are collectively disposed on the upper surface 624.

Figure 17:
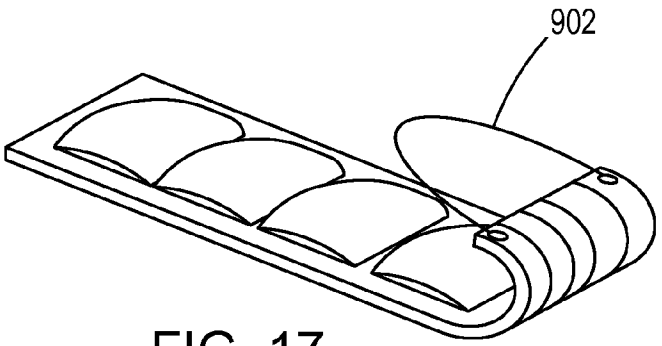
FIG. 16-18 are each a perspective view of a different embodiment of a slide device.
Figure 18:
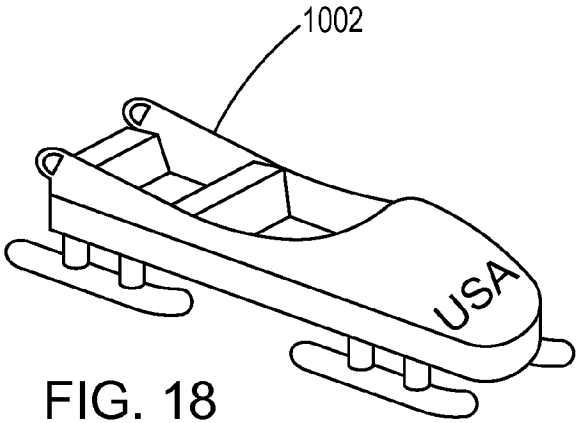
Figure 16:
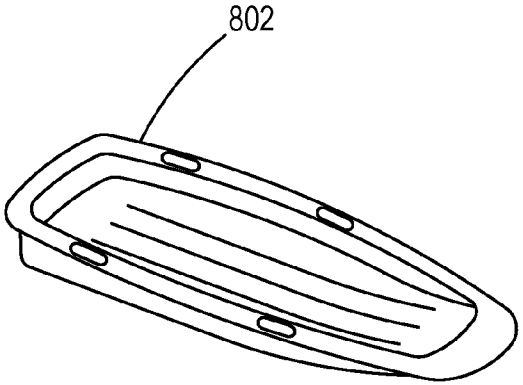

FIGS. 16-18 each illustrate a further embodiment of a slide device that can be included in a kit as described herein. FIG. 16 illustrates a slide device 802 and FIG. 17 illustrates a slide device 902 each in the form of a sled. FIG. 18 illustrates a slide device 1002 in the form of a bobsled. In each of the embodiments of a slide device shown in FIGS. 16-18, an action figure (not shown) can be disposed on the slide device, for example, in a seated position.

Figure 20:
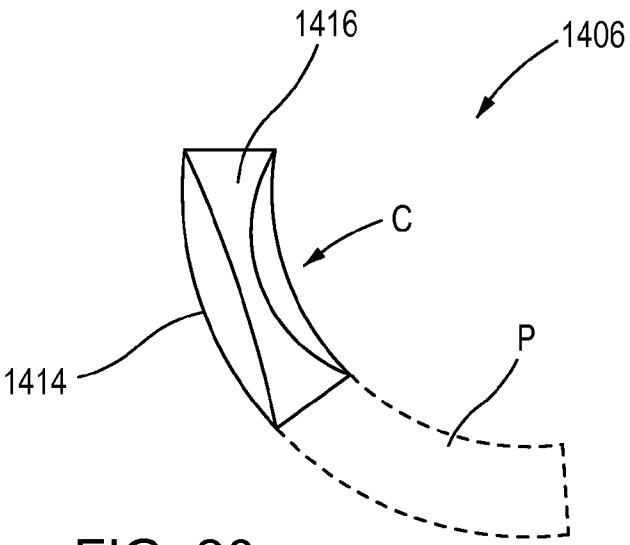
FIG. 20 is a top view of a tool member, according to another embodiment.
Figure 19:
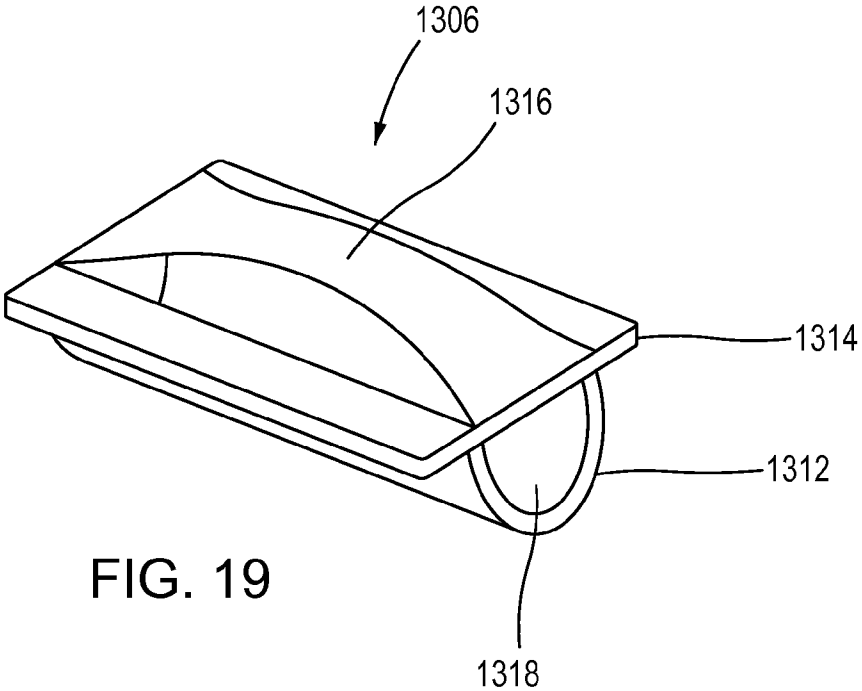
FIG. 19 is a side perspective view of a tool member, according to another embodiment.
Figure 21:
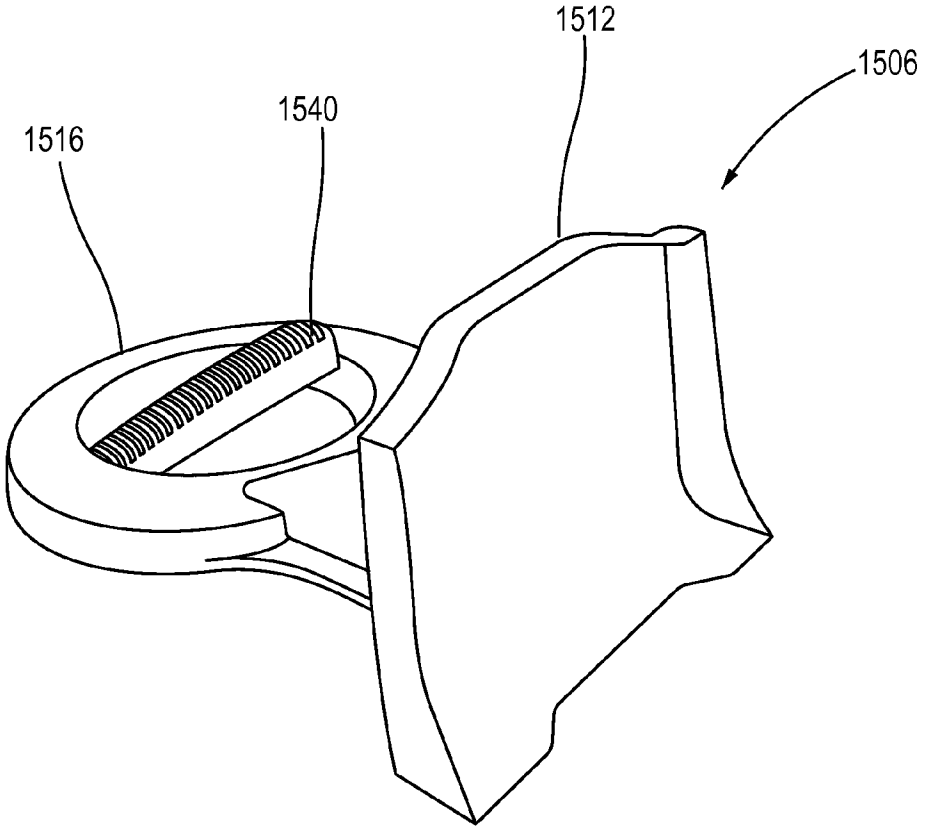
FIG. 21 is a side perspective view of a tool member, according to another embodiment.

FIGS. 19-21 each illustrate an embodiment of a tool member that can be used to form a path in a base material (e.g., snow or sand). Each of the embodiments of a tool member shown in FIGS. 19-21 and the tool member 306 can be included in a kit and/or can be provided separately. Each of the embodiments of a tool member shown in FIGS. 19-21 can be used in the same or similar manner as tool members 106 and 306 to form a path in a base material on which a slide device (not shown in FIGS. 19-21) and an action figure (not shown in FIGS. 19-21) can slide down.

FIG. 19 illustrates a tool member 1306 that is similar to the tool member 306. The tool member 1306 includes a tool body 1312 coupled to a support member 1314. A handle 1316 is formed monolithically with the support member 1314. The tool member 1306 can be used to form a path (not shown in FIG. 19) in a base material (not shown in FIG. 19) in the same or similar manner as described above for tool member 306. The tool body 1312 defines an interior region 1318 that can define a shape and size of the path that can be formed in the base material. A height of the tool body 1312 can be, for example, greater than at least one half the height of a slide device (not shown in FIG. 19) and action figure (not shown in FIG. 19) collectively such that a path formed in the base material by the tool member 1306 can have a height that is greater than at least one half the height of the slide device and action figure collectively. The tool body 1312 can have a width, for example, that is greater than a width of the action figure and slide device collectively such that the path formed by the tool member 1306 has a width greater than the width of the action figure and slide device collectively.

FIG. 20 illustrates a tool member 1406 that is similar to the tool member 1306. The tool member 1406 includes a tool body (not shown in FIG. 20) coupled to a support member 1414 and a handle 1416 formed monolithically with the support member 1414. The tool body can be sized (e.g., have a height, length and width) as described above for tool body 312 and tool body 1312. In this embodiment, the tool body and the support member 1414 are each curved in a direction of the width of the tool body as shown at C in FIG. 20 such that the tool member 1406 can be used to form a path P that has a curvature as shown in dashed lines in FIG. 20. The amount or degree of curvature of the tool body and support member 1414 can vary. For example, the degree of curvature can be 45 degrees, 25 degrees, 30 degrees, 60 degrees, 90 degrees, or any degree of curvature between, for example, 0 and 180 degrees.

In alternative embodiments, a tool member can include other shapes and configurations. For example, in one alternative, a tool member can include an angled front portion similar to the front of a bow of a ship or similar to the front of a snow plow. In such an embodiment, the tool member can be moved or pushed through the base material (e.g., snow or sand) to form a path in the base material. In another alternative, a tool member can include a tool body that includes cylindrical portion and a non-cylindrical portion. For example, the tool body can include a portion that has a cylindrical cross-section and a portion that has a square or rectangular cross-section. The portion with the cylindrical cross-section can be disposed, for example, on a bottom portion of the tool member. In another alternative, a tool member can include a tool body that includes at least a portion that has a substantially u-shaped cross-section disposed on a bottom portion of the tool member.

FIG. 21 illustrates a tool member 1506 that includes a tool body 1512, a handle 1516 and a grip portion 1540. The tool body 1512 includes a curved portion and can modify the shape and/or move a base material (e.g., snow or sand) to form a path for a slide device and action figure to collectively slide down.

Figure 22:
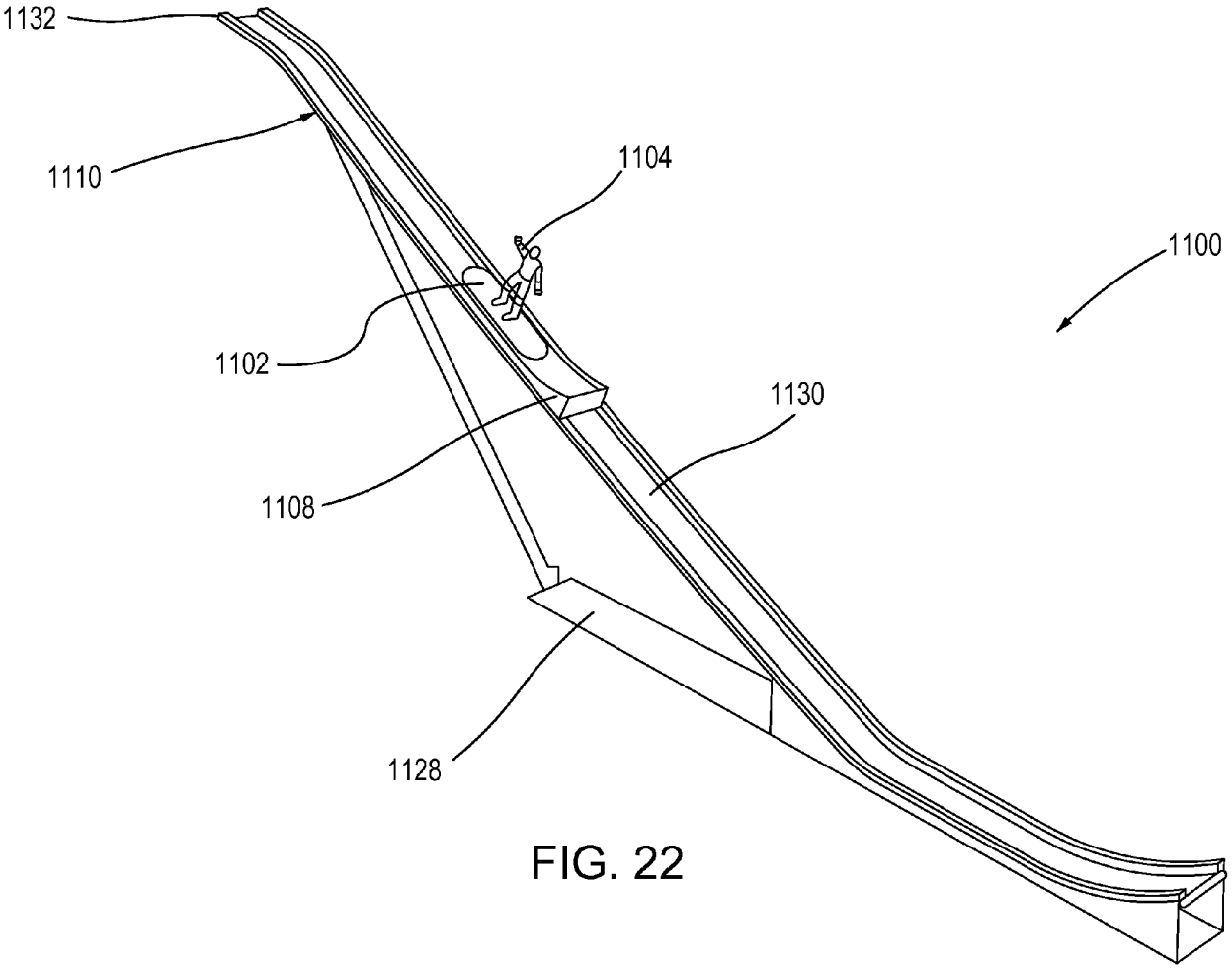
FIG. 22 is a perspective view of a track device according to an embodiment and a slide device and action figure according to an embodiment disposed on the track device.

FIG. 22 illustrates components of a kit, according to another embodiment. A kit 1100 includes a track device 1110, a slide device 1102, an action figure 1104 and an accessory member 1108. In this embodiment, the slide device 1102 is in the form of a snowboard and the action figure 1104 is the form of a person (e.g., snowboarder). The action FIG. 1104 can be coupled to the slide device 1102 with various coupling methods, such as, for example, a snap-fit coupling or a press-fit coupling. The slide device 1102 includes a substantially planar bottom surface (not shown in FIG. 22) that can slide on the track device 1110 as described in more detail below.

Figure 23:
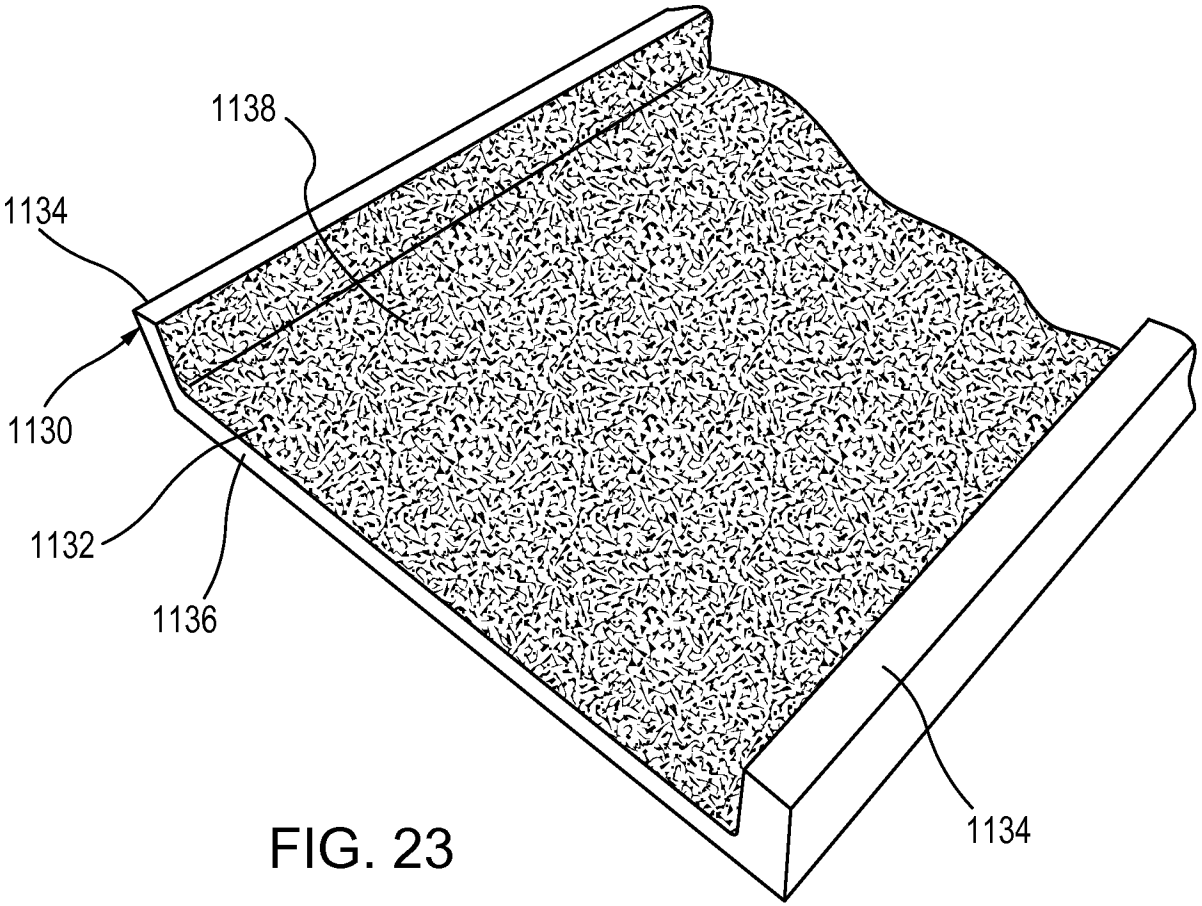
FIG. 23 is an enlarged view of a portion of the track device of FIG. 22.

The track device 1110 includes a support 1128 and a track 1130. The track 1130 can be formed monolithically with the support 1128 or can be coupled to the support 1128. The track 1130 can be formed with, for example, a HDPE material or a UMHW PE material, or both, and can have an upper surface 1132 that is textured (see also FIGS. 23-24). The upper surface 1132 can slidably contact the substantially planar surface of the slide device 1102 when the slide device 1102 and the action figure 1104 collectively slide down at least a portion of the track device 1110. The textured surface of the track 1130 can include a base portion 1136 and multiple raised portions 1138 that protrude above the base portion 1136 to form the textured surface 1132. As shown in FIG. 23, the textured surface of the track 1130 can have a surface coefficient of friction that is lower than a surface coefficient of friction of a track that does not have a textured surface (e.g., has a surface that is smooth). The lower surface coefficient of friction of the material of the track 1130 can provide for reduced friction between the substantially planar surface of the slide device 1102 and the surface 1132 of the track 1130 that contacts the substantially planar surface of the slide device 1102 when the slide device 1102 and action figure 1104 collectively slide on at least a portion of the track 1130. The track 1130 also includes raised wall portions 1134 on each side of the track 1130. The raised wall portions 1134 can help maintain the slide device 1102 and action FIG. 1104 collectively on the track 1130 when sliding down the track 1130.

Returning to FIG. 22, the accessory member 1108 is coupled to the track 1130 such that the slide device 1102 and the action figure 1104 can collectively slide on an upper surface of the accessory member 1108 when sliding down the track 1130 of the track device 1110. In this embodiment, the accessory member 1108 is in the form of a jump that has a concave upper surface similar to the accessory member 608 described above. The accessory member 1108 can be coupled to the track device 1110 with a snap-fit coupling, a press-fit coupling, hook and loop coupling, snaps, threaded fasteners, or other suitable coupling method. The accessory member 1108 can be coupled to the track 1130 and/or the support 1128 of the track device 1110. Although not shown in FIG. 22, the kit 1100 can also optionally include other accessories, such as a start flag, a finish flag, a bridge member, and/or a tunnel member, each of which can be disposed on or coupled to the track device 1110. The kit 1100 can also optionally include additional accessory members in the form of a jump (e.g., 408, 508).

Figure 24:
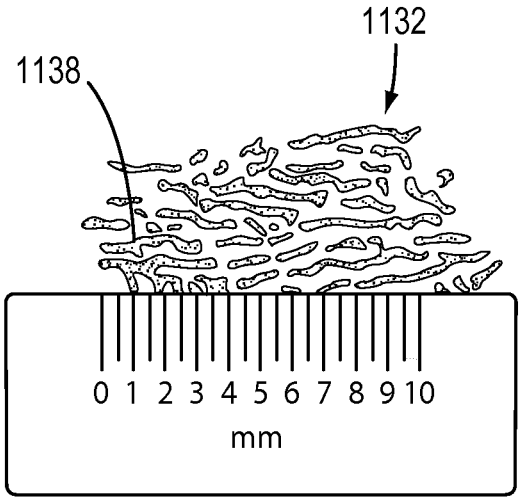
FIG. 24 is an enlarged view of a portion of the track device of FIG. 22 illustrating a textured surface of the track device.

FIG. 24 is an enlarged view illustrating a portion of the upper textured surface 1132 of the track 1130. As shown in FIG. 24, the raised portions 1138 of the textured surface 1132 of the track 1130 can have various shapes and sizes. For example, the raised portions 1138 can have a length between, for example, about 0.5 mm and 5.0 mm and a width between, for example, about 0.2 mm and about 0.5 mm. In this embodiment, the raised portions 1138 are not entirely straight, but have random turns. The raised portions 1138 are separated by a gap that can vary in size and shape. For example, the gap can be between about 0.2 mm and about 1.0 mm. In some embodiments, the raised portions 1138 can be generally elongate shaped and oriented along their length in a direction substantially parallel to the longitudinal direction of the track 1130. In other words, the action figure and slide device can slide or move down the track 1130 in a direction that is generally aligned with the direction of the raised portions 1138.

Figure 25:
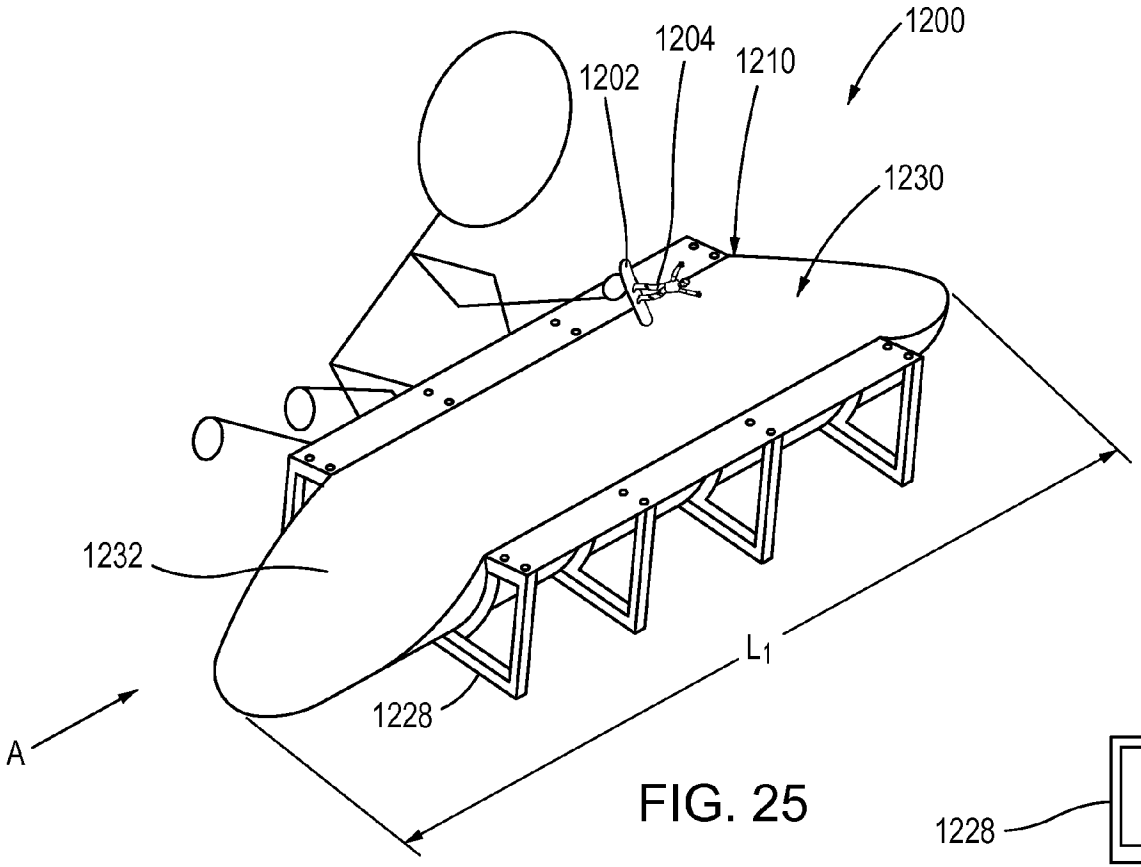
FIG. 25 is a perspective view of a track device according to another embodiment and a schematic illustration of a user placing a slide device and action figure on the track device.

FIG. 25 illustrates components of a kit, according to another embodiment. A kit 1200 includes a track device 1210, a slide device 1202, and an action figure 1204. In this embodiment, the slide device 1202 is in the form of a snowboard and the action figure 1204 is the form of a person (e.g., snowboarder). The action figure 1204 can be coupled to the slide device 1202 with various coupling methods, such as, for example, a snap-fit coupling or a press-fit. The slide device 1202 includes a substantially planar bottom surface (not shown in FIG. 25) that can slide on the track device 1210 as described in more detail below.

Figure 26:
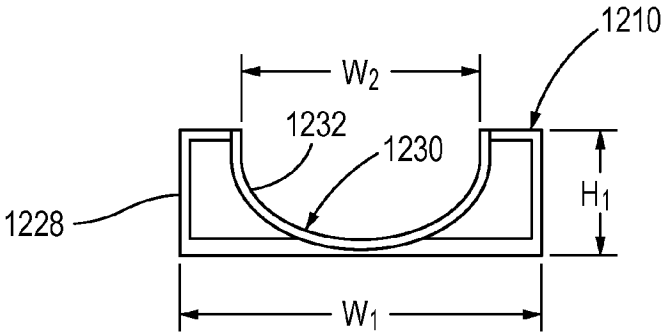
FIG. 26 is an end view in the direction of Arrow A in FIG. 25 of the track of FIG. 25.

The track device 1210 includes a support 1228 and a track 1230. The track 1230 can be formed monolithically with the support 1228 or can be coupled to the support 1228. The track 1230 can be formed with, for example, a HDPE material or a UMHW PE material, or both, and can have an upper surface 1232 that is textured as described above for track 1130. The upper surface 1232 can slidably contact the substantially planar surface of the slide device 1202 when the slide device 1202 and the action figure 1204 collectively slide down at least a portion of the track device 1210. In this embodiment, the track 1230 has a concave curvature forming, for example, a bowl shape (see also FIG. 26), that can help maintain the slide device 1202 and action figure 1204 collectively disposed within the track 1230 when sliding down the track 1230. As shown in FIGS. 25 and 26, the track device 1210 can have a length $L_1$, for example, in the range of 30-36 inches, a width $W_1$, for example, of 18 inches, and a height $H_1$, for example, of 6 inches. The track 1230 can have a width $W_2$, for example, of 14 inches, as shown in FIG. 26.

Although not shown in FIG. 25, the kit 1200 can also optionally include other accessories, such as a start flag, a finish flag, a bridge member, and/or a tunnel member, each of which can be disposed on or coupled to the track device 1210. The kit 1200 can also optionally include additional accessory members in the form of a jump (e.g., 408, 508, 608, 1108) as described above for previous embodiments.

Various embodiments of kits and components of kits (e.g., slide devices, action figures, tool members, track devices, and accessory members) are described herein. Although kits are described with respect to specific embodiments having specific components (e.g., slide device, action figure, etc.), it should be understood that the kits described herein can alternatively include other components as described herein. For example, a kit can include one or more action figures, one or more slide devices, one or more track devices, one or more tool members, and/or one or more accessory members. In addition, the various components of a kit described herein can be provided separately (not provided within a kit).

Figure 27:
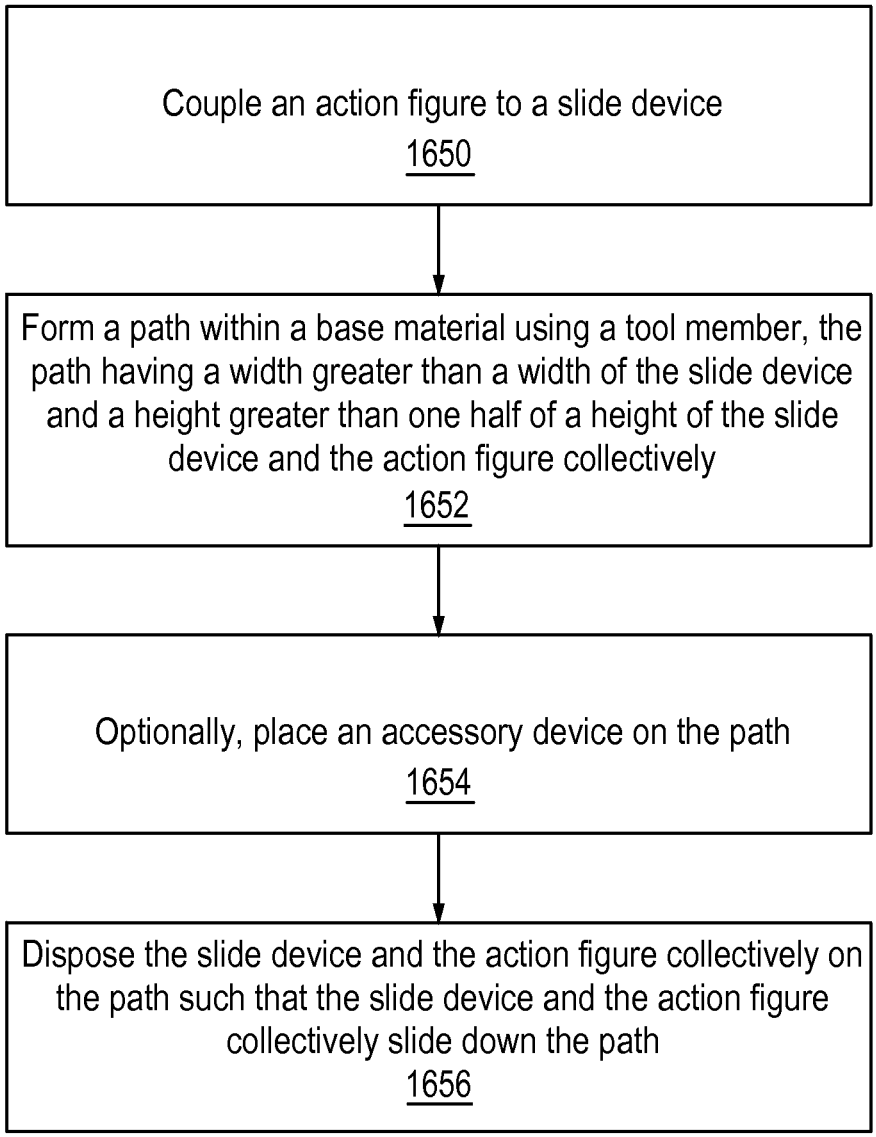
FIG. 27 is a flowchart illustrating a method of using a slide device, action figure and tool, according to an embodiment.

FIG. 27 is a flowchart illustrating a method of forming a path and using a slide device and action figure described herein. The method includes at 1650, coupling an action figure (e.g., 104, 204, 304, etc.) to a slide device (e.g., 104, 204, 304, etc.). For example, as described herein an action figure can be coupled to the slide device with, for example, a snap-fit coupling or a press-fit coupling. At 1652, a path can be formed in a base material (e.g., snow or sand) using a tool member (e.g., 106, 306, 1306, 1406, 1506), as described herein. The path can be formed either before or after the action figure is coupled to the slide device. At 1654, one or more an accessory members (e.g., 108, 208, 308, 408, etc. and/or an accessory device such as a start flag, finish flag, etc.) can optionally be placed or disposed on the path formed in the base material. For example, an accessory member such as a jump (e.g., 308, 408, 508, etc.) can be disposed at a desired location on the path. At 1656, the slide device and action figure can be collectively placed or disposed on the path formed in the base material. For example, the path can be formed on a base material that has a slope (e.g., a hill) and the slide device and the action figure can be disposed on the path at a location on the path such that the slide device and action figure collectively slide down at least a portion of the path.

While various embodiments have been described above, it should be understood that they have been presented by way of example only, not limitation, and various changes in form and details may be made. Any portion of the apparatuses and/or methods described herein may be combined in any combination, except mutually exclusive combinations. Where methods and steps described above indicate certain events occurring in certain order, those of ordinary skill in the art having the benefit of this disclosure would recognize that the ordering of certain steps may be modified and that such modifications are in accordance with the variations of the invention. Additionally, certain of the steps may be performed concurrently in a parallel process when possible, as well as performed sequentially as described above.

Although various embodiments have been described as having particular features and/or combinations of components, other embodiments are possible having any combination or sub-combination of any features and/or components from any of the embodiments described herein. The specific configurations of the various components can also be varied. For example, the size and specific shape of the various components can be different than the embodiments shown, while still providing the functions as described herein. Furthermore, each feature disclosed herein may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A kit, comprising:

a toy slide device;

an toy action figure couplable to the toy slide device; and a handheld tool having a tool body, the tool body defining an interior region having a shape and a size, the tool body configured to modify a shape of a base material when used by a user such that a path is defined within the base material having a shape and a size substantially corresponding to the shape and the size, respectively, of the interior region of the tool body, the toy action figure and the toy slide device collectively configured to slide down at least a portion of the path when disposed on the path.

2. The kit of claim 1, wherein the base material is at least one of snow or sand.

3. The kit of claim 1, wherein the path has a height greater than one half of a height of the slide device and the action figure collectively.

4. The kit of claim 1, wherein the slide device and the action figure collectively have a height relative to the height of the path such that the slide device and the action figure maintain a substantially upright orientation when sliding down the path.

5. The kit of claim 1, wherein the path includes a curved portion, the slide device and the action figure collectively configured to maintain a substantially upright orientation when sliding down the curved portion of the path.

6. The kit of claim 1, further comprising:

an accessory device configured to be disposed on the path, the slide device and the action figure collectively configured to slide on a surface of the accessory device when sliding down the path.

7. The kit of claim 1, wherein the slide device is in the form of a snowboard, the action figure being coupled to a top surface of the slide device.

8. The kit of claim 1, wherein the slide device is in the form of a snow mobile, the action figure being coupled to the slide device in a seated position.

9. The kit of claim 1, wherein the slide device is in the form of a pair of skis, the action figure being coupled to the slide device such that a first foot of the action figure is coupled to a first ski from the pair of skis and a second foot of the action figure is coupled to a second ski from the pair of skis.

10. The kit of claim 1, wherein the slide device is in the form of a sled, the action figure being coupled to the slide device in a seated position.

11. The kit of claim 1, wherein the interior region of the tool body has a width and a height, the tool body configured to modify the shape of the base material such that the path defined within the base material has a width and a height substantially corresponding to the width and the height, respectively, of the interior region of the tool body.

12. The kit of claim 1, further comprising:

a ramp member configured to be disposed on the path, the slide device and the action figure collectively configured to slide on a surface of the ramp member when sliding down the path.

13. The kit of claim 1, wherein the tool body has a substantially cylindrical shape.

14. A method, comprising:

forming a path within a base material using a handheld tool member, the handheld tool member having a tool body defining an interior region having a width and a height, the path having a width and a height substantially corresponding to the width and the height, respectively, of the interior region of the handheld tool body, the width of the path being greater than a width of a slide device and the height of the path being greater than one half of a height of the slide device and an action figure collectively; and disposing the slide device and the action figure collectively on the path such that the slide device and the action figure collectively slide down the path.

15. The method of claim 14, wherein the base material is at least one of snow or sand.

16. The method of claim 14, wherein the slide device and the action figure are configured to collectively maintain a substantially upright orientation when sliding down the path.

17. The method of claim 14, wherein the forming the path includes forming a path including a curved portion, the slide device and the action figure collectively configured to maintain a substantially upright orientation when sliding down the curved portion of the path.

18. The method of claim 14, further comprising:

prior to disposing the slide device and the action figure on the path, placing an accessory device on the path, the slide device and the action figure collectively configured to slide on a surface of the accessory device when sliding down the path.

19. The method of claim 14, further comprising:

prior to disposing the slide device and the action figure on the path, coupling the action figure to the slide device.

20. The method of claim 14, further comprising:

prior to disposing the slide device and the action figure on the path, placing a ramp member on the path, the slide device and the action figure collectively configured to slide on a surface of the ramp member when sliding down the path.

* * * * *

UNITED STATES PATENT AND TRADEMARK OFFICE

CERTIFICATE OF CORRECTION

PATENT NO. : 9,039,480 B2
APPLICATION NO. : 13/415435
DATED : May 26, 2015
INVENTOR(S) : Ryan Wolfinbarger It is certified that error appears in the above-identified patent and that said Letters Patent is hereby corrected as shown below:

In the specification,

Column 9, Line 42: "FIG." should be --figure--.

Column 10, Line 6: "FIG." should be --figure--.

Signed and Sealed this
Twenty-third Day of February, 2016

Michelle K. Lee

Michelle K. Lee
*Director of the United States Patent and Trademark Office*